US006314927B1

(12) United States Patent
Schnell

(10) Patent No.: US 6,314,927 B1
(45) Date of Patent: Nov. 13, 2001

(54) SUPPORT ELEMENT FOR A FINGER LEVER OF A VALVE GEAR OF AN INTERNAL COMBUSTION ENGINE

(75) Inventor: Oliver Schnell, Weisendorf (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/673,824

(22) PCT Filed: Feb. 6, 1999

(86) PCT No.: PCT/EP99/00798

§ 371 Date: Oct. 19, 2000

§ 102(e) Date: Oct. 19, 2000

(87) PCT Pub. No.: WO99/56008

PCT Pub. Date: Nov. 4, 1999

(30) Foreign Application Priority Data

Apr. 29, 1998 (DE) ..... 198 19 068

(51) Int. Cl.[7] ..... F01L 13/00; F01L 1/24

(52) U.S. Cl. ..... 123/90.16; 123/90.43; 123/198 F

(58) Field of Search ..... 123/90.15, 90.16, 123/90.39, 90.41, 90.42, 90.43, 90.46, 198 F

(56) References Cited

U.S. PATENT DOCUMENTS

| | | | | |
|---|---|---|---|---|
| 4,222,354 | | 9/1980 | Uitvlugt | 123/90.16 |
| 5,655,487 | * | 8/1997 | Maas et al. | 123/90.16 |
| 5,875,748 | * | 3/1999 | Haas et al. | 123/90.16 |
| 5,960,756 | * | 10/1999 | Miyachi et al. | 123/90.16 |

FOREIGN PATENT DOCUMENTS

| | | |
|---|---|---|
| 2814307 | 10/1979 | (DE) . |
| 4000531 | 6/1990 | (DE) . |
| 19500575 | 7/1996 | (DE) . |
| 0814240 | 12/1997 | (EP) . |
| 2356006 | 6/1977 | (FR) . |
| 2068495 | 8/1981 | (GB) . |

* cited by examiner

*Primary Examiner*—Weilun Lo
(74) *Attorney, Agent, or Firm*—Bierman, Muserlian and Lucas

(57) ABSTRACT

A support element for a cam follower of a valve gear of an internal combustion engine configured so that it can be switched which allows the pressure piston to complete a movement in relation to the housing whereby the support element is switched off.

11 Claims, 2 Drawing Sheets

SUPPORT ELEMENT FOR A FINGER LEVER OF A VALVE GEAR OF AN INTERNAL COMBUSTION ENGINE

This application is a 371 of PCT/EP99/00798 filed Feb. 6, 1999.

FIELD OF THE INVENTION

The invention concerns a support element for a finger lever of a valve train of an internal combustion engine having the following features:

the support element comprises a housing which is installed or can be installed in a reception of a cylinder head, a pressure piston biased toward the finger lever by a spring means being inserted into a bore of the housing;

the pressure piston extends beyond the reception of the cylinder head and possesses a head that serves as a support for the finger lever;

the support element can be switched to a high and a low or a zero lift for at least one gas exchange valve associated to the finger lever and comprises a switching means for switching to the lifts, the switching means comprises a coupling means and an actuating means for the coupling means, whereby for achieving the high lift, the housing can be connected to the pressure piston by the coupling means in an axially distant relative position, and for achieving the low or zero lift, the housing and the pressure piston can be disconnected from the intervention of the coupling means.

CRITICISM OF PRIOR ART

A support element of the pre-cited type is disclosed in DE-OS 195 00 575. A drawback of this support element is that locking and unlocking is realized by transversely displaceable pistons that are actuated at least in one of their directions of movement by a hydraulic medium. This hydraulic actuation is accompanied by a number of disadvantages, one of which, for example, is that the time required for switching the pistons depends on the viscosity of the hydraulic medium used. Another disadvantage is that complicated additional hydraulic medium ducts have to be provided in the neighboring area of the cylinder head and further, that impurities contained in the hydraulic medium can lead to a clamping of the pistons. Since the hydraulic medium column in front of the pistons is subject to undesired pressure fluctuations, these can lead, in the worst case, to a displacement of the pistons when this is not desired. Still another drawback of this prior art support element is its relatively large design space requirement.

SUMMARY OF THE INVENTION

The object of the invention is therefore to create a support element of the pre-cited type in which the mentioned drawbacks are eliminated, and in which, particularly, an economic and reliable displacement of the coupling means is assured.

The above object is achieved according to the invention through the features of:

an outer peripheral surface of the pressure piston comprises, preferably outside of the reception of the cylinder head, at least one flat portion whose axial dimension corresponds at least to a length of a stroke of the pressure piston relative to the housing in a separated state of the pressure piston and the housing;

the outer peripheral surface is surrounded in a region of the flat portion by a bore of a lever serving as the coupling means, said bore comprising an unrecessed section on the side of flat portion and of complementary shape to the flat portion;

the lever extends generally perpendicularly away from an axial line of the support element and is displaceable in rotating direction by the actuating means;

in the axially distant relative position of the housing and the pressure piston, the pressure piston comprises, as seen in peripheral direction, an annular groove starting from the flat portion and extending on one or both sides thereof, a depth of the annular groove corresponding at least to the depth of the unrecessed section;

to achieve the low lift or the zero lift, the lever can be rotated by the actuating means so that the unrecessed section of the lever and the flat portion of the pressure piston come to be situated directly opposite each other, and for achieving the high lift, the lever can be rotated by the actuating means so that at least a part of the unrecessed section of the lever extends within the annular groove of the pressure piston, and an anti-rotation device is arranged between the pressure piston and the housing.

The disadvantages discussed above are eliminated by the switching means as described above in combination with the actuating means (32) can be displaced in a first direction of displacement by an electromagnetic or electrohydraulic actuator (33), a displacement of the actuating means (32) in a direction opposite to the first direction of displacement being accomplished either by a mechanical setting means (34) such as at least one compression spring (35), or likewise by the actuator (33). The lever guarantees a reliable and very rapid connection and separation of the pressure piston and the housing for achieving the different lifts. The scope of the invention also extends to a solution in which the support element is not completely switched off so that the gas exchange valve concerned still undergoes a partial lift through the action of the cam-contacted finger lever of the support element.

Although it is proposed to configure at least one flat portion and one section on the pressure piston and the housing, two such configurations situated diametrically opposite each other are particularly advantageous.

In a further development of the invention, the support element is configured as a hydraulic clearance compensation element. In this way, complicated mechanical measures for clearance adjustment can be dispensed with.

It is also within the scope of the invention to configure the flat portion on the pressure piston with a length that corresponds at least to the displacement of the pressure piston relative to the housing in the switched-off state. This flat portion extends up to a head-proximate end of the pressure piston. This measure is particularly favorable from the manufacturing point of view.

According to a further feature of the invention, the reception-proximate surface of the lever is supported on a shoulder formed by the flat portion of the pressure piston. In this way, no additional support means are required for the lever on the support element.

It is understood that means similar to those provided by the invention can also be used to fix the pressure piston in its retracted state in the housing (separation from cam lift). This further reduces friction in the valve train because the pressure piston then no longer executes a movement relative to the housing (zero lift) when the cam rotates. A re-setting is advantageously effected in the run-off flank phase of the cam.

Since the invention requires a positioning of the flat portion relative to the section, a simple-to-manufacture anti-rotation device is proposed that prevents a rotation of the pressure piston relative to the housing. This device can be in the form of a rivet or the like that extends radially inward through the housing and into a longitudinal recess in the outer peripheral surface of the pressure piston. However, it is also conceivable to arrange this rivet in the pressure piston and have it extend radially outward into a corresponding recess of the housing.

In accordance with the invention, the actuating means for the lever can be configured as a rod, or similar to a rod, and be arranged in the cylinder head parallel to the longitudinal axis thereof. The levers for a row of identically operating gas exchange valves can then be connected to each rod.

An electromagnetic actuator is preferably proposed as a simple actuating means for the rod, or an electrohydraulic actuator may also be used. The control of such an actuator is technically relatively simple and has the advantage over a hydraulic actuation of the coupling means of being extremely reliable. At the same time, it is also possible to implement very high speeds of displacement.

It is possible to realize an alternating switching-off operation simply by a special manner of fixing the lever on the rod. At the same time, a third position of switching is provided in which the pressure pistons and housings of all the support elements are connected for achieving a complete cam lift.

The invention further provides means which guarantee an emergency operation or an operation in general of the internal combustion engine when the actuator is deactivated. This is achieved in that the rod is loaded by a setting means such as a compression spring so that all the pressure pistons and housings of the support elements are connected, with the result that all the gas exchange valves open.

However, it is also possible to actuate the rod in both its directions of displacement by the electromagnetic or electrohydraulic actuator.

Advantageously, the lever comprises a slot in the region of the rod and is connected to the rod by a fastening means inserted through the slot. This slot guarantees an unobstructed pivoting motion of the lever when the rod is displaced.

BRIEF DESCRIPTION OF THE DRAWINGS

The invention will now be described more closely with reference to the appended drawings which show.

DETAILED DESCRIPTION OF THE DRAWINGS

Figure 1:
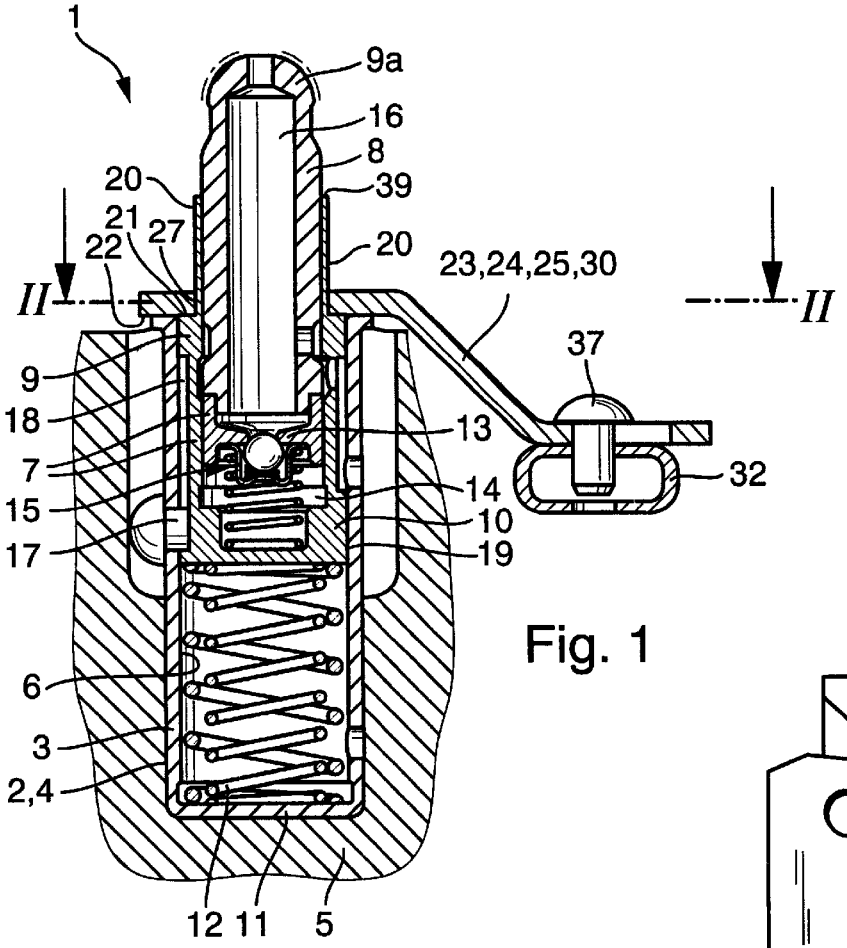
FIG. 1, a longitudinal section through a support element according to the invention, installed in a cylinder head of an internal combustion engine and having switching means, FIG. 2, a transverse section through the support element taken along the sectional line II—II of FIG. 1, including a top view of the coupling means, and FIGS. 3–4, alternative switching positions of the switching means compared to FIG. 2.

FIG. 1 discloses a support element 1 that is installed with an outer peripheral surface 2 of its housing 3 in a reception 4 of a cylinder head 5. A pressure piston 7 extends in a bore 6 of the housing 3 and is axially displaceable relative to the housing 3. In the present embodiment, the pressure piston 7 is a two-piece structure made up of an inner element 8 and an outer element 9. The inner element 8 is mounted for displacement relative to the outer element 9. The outer element 9 comprises a bottom 10 facing the reception 4. A spring means 12 such as one or more compression springs is arranged between the bottom 10 and a reception-proximate bottom 11 of the housing 3. The spring means 12 biases the pressure piston 7 in a direction away from the reception 4.

The inner element 8 comprises a reception-distal head 9*a* on which an end of a finger lever, not shown, is supported. This finger lever is loaded by a cam of a camshaft and its other end rests in lifting direction on at least one gas exchange valve.

A high pressure chamber 14 for hydraulic medium extends between the bottom 10 and a reception-proximate web 13 of the inner element 8. The high pressure chamber 14 is limited in a direction toward the head 9*a* by a one-way valve 15 that is fixed on the web 13. The high pressure chamber 14 is fed with hydraulic medium from a reservoir 16 enclosed in the inner element 8.

It can also be seen that an anti-rotation device 17 such as a rivet projects radially inward through the housing 3. Radially on the inside, this rivet extends in a longitudinal recess 18 in the outer peripheral surface 19 of the outer element 9.

Above the cylinder head 5, the pressure piston 7 comprises two diametrically opposite flat portions 20 extending toward its head. These flat portions 20 form a shoulder 21. A reception-proximate surface 22 of a component (to be described in the following) of a switching means 23 rests on the shoulder 21. The mentioned component is configured in the present embodiment as a coupling means 24 and has the shape of a lever 25. This lever 25 comprises a bore 26 (see also FIG. 2) which surrounds the outer peripheral surface 19 of the pressure piston 7 in the region of the shoulder 21 and the flat surface 20.

In the region of each flat portion 20, the bore 26 of the lever 25 comprises an opposing unrecessed section 27. Outside of the flat portion 20, an annular groove 28 extends, as viewed in rotation direction, adjacent the flat portion 20 in the outer peripheral surface 19 of the outer element 9. The annular groove 28 has a depth that corresponds at least to that of the unrecessed section 27. At the same time, the length of the flat portion 20 is dimensioned so as to correspond to the desired switching-off height of the pressure piston 7 relative to the housing 3.

With its arm 30, the lever 25 extends perpendicular to the axial line of the support element 1. The actuating means 32 of the coupling means 24 is made as a rod 31 and extends parallel to a row of identically operating support elements 1. Each of the support elements 1 of a row of identically operating support elements, for example, can comprise a lever 25 coupled to the rod 31. An actuator 33 such as an electromagnet or the like is arranged on one end of the rod 31. The actuator 33 effects a longitudinal displacement of the rod 31 and thereby switches the support element 1 on or off. A re-displacement against the actuating direction of the actuator 33 can be effected by a setting means 34 such as a compression spring 35.

It can be seen further that in the region of the rod 31, the lever 25 comprises a slot 36. A fastening means 37 such as a rivet or the like is inserted through this slot 36 and connected to an associated hole 38 of the rod 31.

Figure 2:
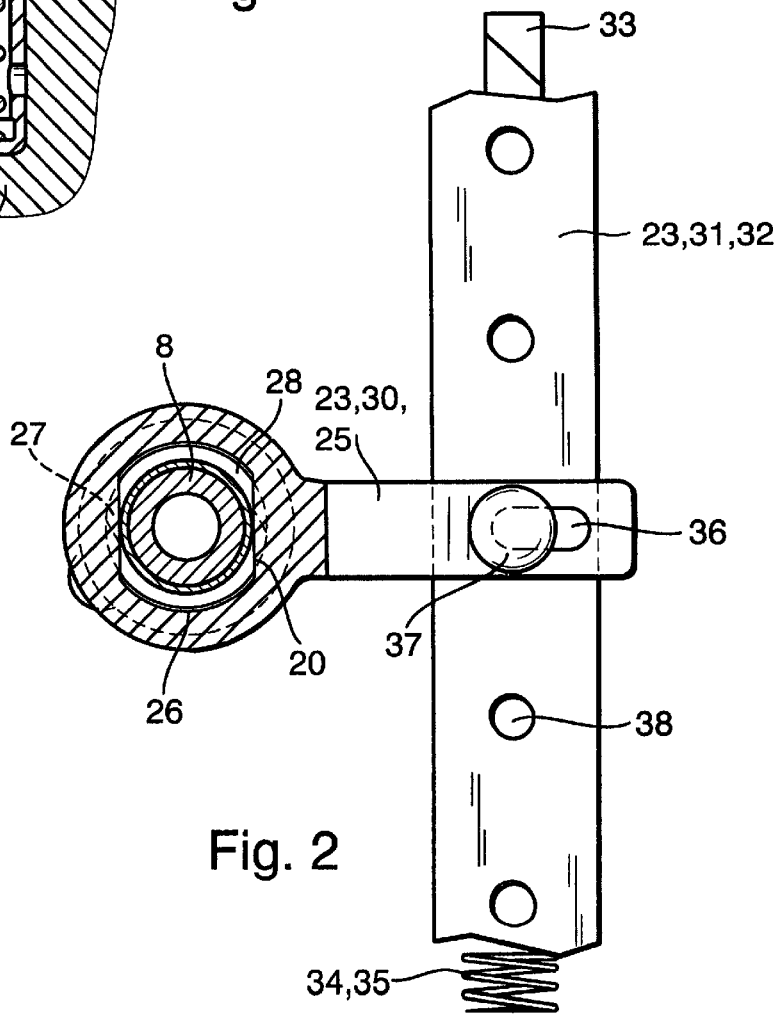

FIG. 2 shows the pressure piston 7 and the housing 3 in a state of disconnection brought about by the lever 25, which means that the support element 1 is switched off. During cam lift, the pressure piston 7 executes a relative movement toward the bottom 11 of the housing 3. The gas exchange valve concerned remains closed. In this state, the flat regions 20 and the unrecessed sections 27 are situated opposite each other.

Figure 3:
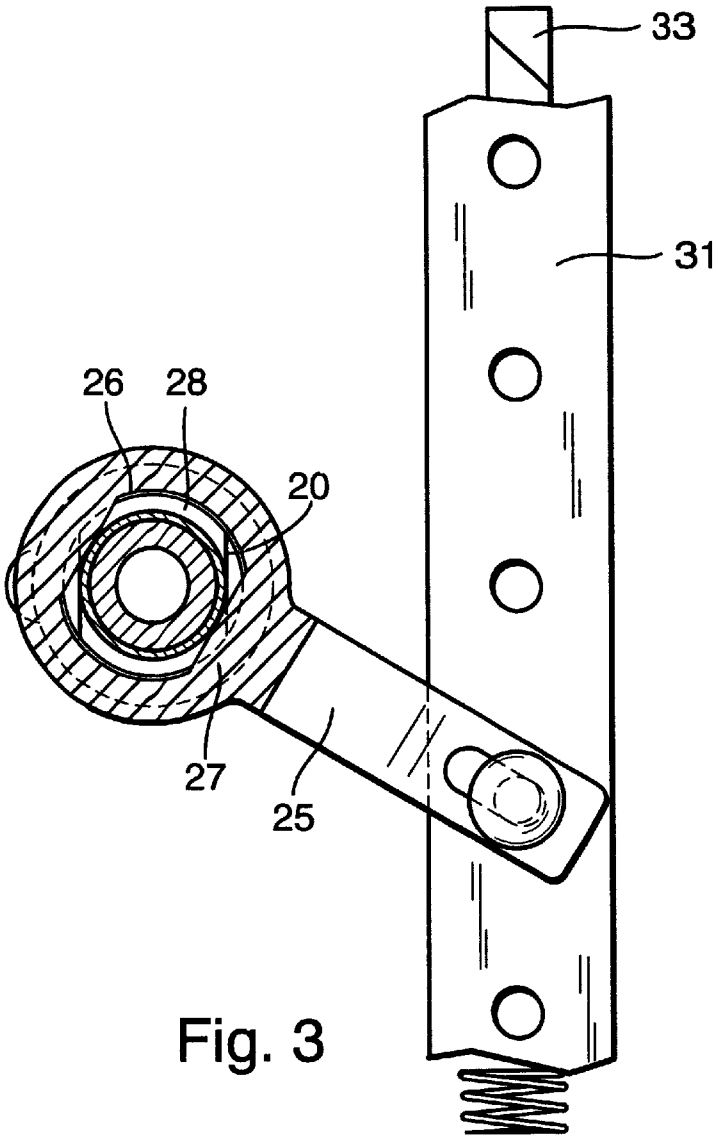

For switching on the support element 1, the lever 25, when it is in a position of maximum axial extraction from the housing 3 (shown in FIG. 1), is pivoted by the rod 31 to the extent shown in FIG. 3. A part of the flat portion 20 of the lever 25 then extends in the annular groove 28 in the outer peripheral surface 19 of the pressure piston 7.

It is also within the scope of the invention to connect the levers 25 for the support elements 1 of a number of cylinders of an internal combustion engine to the rod 31 in the manner shown in FIG. 2, and, at the same time, to connect a further number of cylinders in the manner disclosed in FIG. 3. In this way, an axial displacement of the rod 31 results in an alternating switching-off operation with the advantages well-known in the art.

Figure 4:
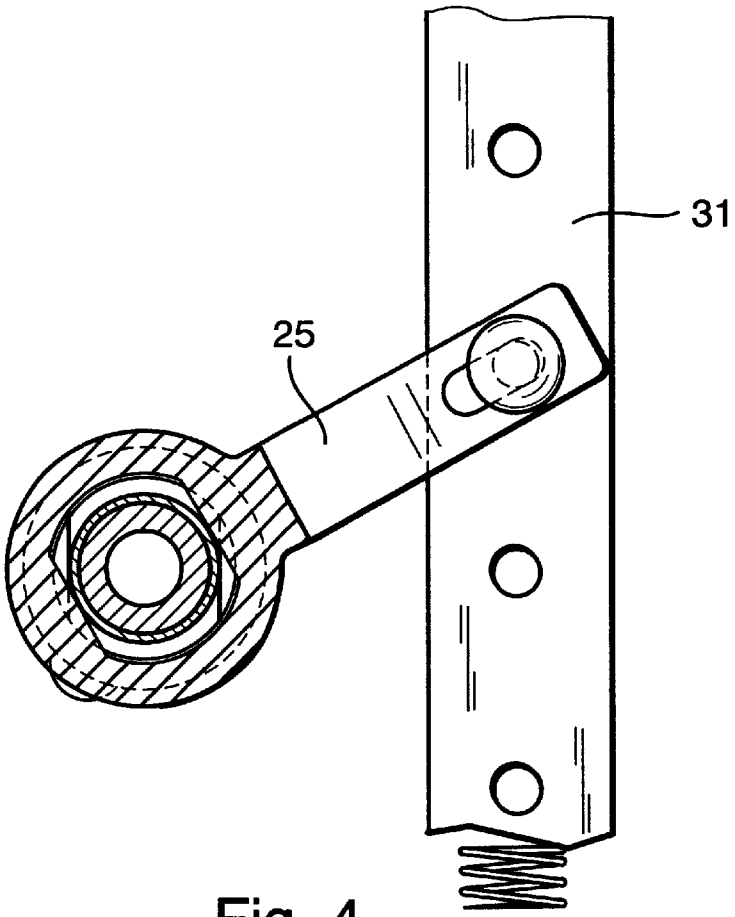

For a simultaneous operation of all the cylinders, or, for example, for starting the internal combustion engine, or for an emergency operation, the rod 31 can de displaced to the extent disclosed in FIG. 4 so that the pressure pistons 7 and the housings 3 of all the support elements 1 are connected.

What is claimed is:

1. A support element (1) for a finger lever of a valve train of an internal combustion engine having the following features:

a) the support element (1) comprises a housing (3) which is installed in a reception (4) of a cylinder head (5), a pressure piston (7) biased toward the finger lever by a spring means (12) being inserted into a bore (6) of the housing (3);

b) the pressure piston (7) extends beyond the reception (4) of the cylinder head (5) and possesses a head (9*a*) that serves as a support for the finger lever;

c) the support element (1) can be switched to a high and a low or a zero lift for at least one gas exchange valve associated to the finger lever and comprises a switching means (23) for switching to the lifts;

d) the switching means (23) comprises a coupling means (24) and an actuating means (32) for the coupling means (24), whereby for achieving the high lift, the housing (3) is connected to the pressure piston (7) by the coupling means (24) in an axially distant relative position, and for achieving the low or zero lift, the housing (3) and the pressure piston (7) is disconnected from the intervention of the coupling means (24); characterized by the following features:

e) an outer peripheral surface (19) of the pressure piston (7) comprises, outside of the reception (4) of the cylinder head (5), at least one flat portion (20) whose axial dimension corresponds at least to a length of a stroke of the pressure piston (7) relative to the housing (3) in a separated state of the pressure piston (7) and the housing (3);

f) the outer peripheral surface (19) is surrounded in a region of the flat portion (20) by a bore (26) of a lever (25) serving as the coupling means (24), said bore (26) comprising an unrecessed section (27) serving as the coupling means (24), said bore (26) comprising an unrecessed section (27) on the side of the flat portion (20) and of complementary shape to the flat portion (20);

g) the lever (25) extends generally perpendicularly away from an axial line of the support element (1) and is displaceable in rotating direction by the actuating means (32);

h) in the axially distant relative position of the housing (3) and the pressure piston (7), the pressure piston (7) comprises, as seen in peripheral direction, an annular groove (28) starting from the flat portion (20) and extending on one or both sides thereof, a depth of the annular groove (28) corresponding at least to the depth of the unrecessed section (27);

i) to achieve the low lift or the zero lift, the lever (25) is rotated by the actuating means (32) so that the unrecessed section (27) of the lever (25) and the flat portion (20) of the pressure piston (7) come to be situated directly opposite each other, and for achieving the high lift, the lever (25) is rotated by the actuating means (32) so that at least a part of the unrecessed section (27) of the lever 925) extends within the annular groove (28) of the pressure piston (7), and j) an anti-rotation device (17) is arranged between the pressure piston (7) and the housing (3).

2. A support according to claim 1, characterized in that the outer peripheral surface (19) of the pressure piston (7) comprises two flat portions (20) situated diametrically opposite each other, and an unrecessed section (27) is situated near each flat portion (20).

3. A support element according to claim 1, characterized in that the support element (1) is configured as a hydraulic clearance compensation element.

4. A support element according to claim 3, characterized in that the pressure piston (7) is a two-piece structure comprising an outer element (9) having a reception-proximate bottom (10) and an inner element (8) installed in the outer element (9) for displacement relative thereto and having the head (9*a*) for the finger lever, the spring means (12) configured as at least one compression spring extends axially between the bottom (10) and a reception-proximate bottom (11) of the housing 93), a high pressure chamber (14) for hydraulic medium is disposed axially between the reception-proximate web (13) of the inner element (8) and the bottom (10), hydraulic medium out of a reservoir (16) enclosed in the inner element (8) being supplied to the high pressure chamber (14) through a one-way valve (15) arranged on the web (13).

5. A support element according to claim 1 characterized in that a reception-proximate surface (22) of the lever (25), in the region surrounding the bore (26) thereof, extends on a shoulder (21) formed by the flat portion (20) of the pressure piston (7), and said flat portion (20) extends continuously up to a head-proximate end (39) of the pressure piston (7).

6. A support element according to claim 1 characterized in that the anti-rotation device (17) is formed by an extension including a rivet or a needle that projects radially inward through the housing (3) and extends in a longitudinal recess (18) in the outer peripheral surface (19) of the pressure piston (7), said longitudinal recess having a length corresponding at least to the dimension of relative displacement of the pressure piston (7) to the housing (3).

7. A support element according to claim 1 characterized in that the actuating means (32) is made as a rod (31) which is arranged in the cylinder head (5) parallel to the longitudinal axis of the cylinder head (5), a lever (25) coupled to the rod (31) by an arm (30) being associated to at least one support element (1) of a row of identically operating gas exchange valves.

8. A support element according to claim 7, characterized in that for a first number of cylinders of the internal combustion engine, the levers (25) of the support elements (1) for the row of identically operating gas exchange valves are fixed on the rod (31) in a first switching position thereof so that the pressure pistons (7) and housings (3) of these support elements (1) are disconnected, and at the same time, for a second number of cylinders, the other levers (25) of the row are fixed angularly displaced on the rod (31) so that the pressure pistons (7) and housings (3) of the support elements (1) associated to the other levers are connected, the levers (25) for the first and second numbers of cylinders being connected at the same time to the rod (31) in such a way that in a second switching position of the rod (31), the pressure pistons (7) and housings (3) of the support elements (1) of the first number of cylinders are connected and those of the second number are disconnected, and in a third switching position of the rod (31), the pressure pistons (7) and housings (3) of all support elements (1) are connected.

9. A support element according to claim 1 characterized in that the actuating means (32) is displaced in a first direction of displacement by an electromagnetic or electrohydraulic actuator (33), a displacement of the actuating means (32) in a direction opposite to the first direction of displacement being accomplished either by a mechanical setting means (34) such as at least one compression spring (35), or likewise by the actuator (33).

10. A support element according to claim 8 characterized in that the inactive state of the actuator (33), the actuating means (32) is displaced by the setting means (34) so that the pressure pistons (7) and housings (3) of all support elements (1) are connected through the coupling means (24) of the levers (25).

11. A support element according to claim 7, characterized in that the arms (30) of the levers (25) possess in the region of the rod (31), a slot (36) through which a fastening means (37) including a screw, a pin or a rivet which is connected to the rod (31) is inserted.

* * * * *